US006152500A

United States Patent [19]

Kowalewski et al.

[11] Patent Number: 6,152,500

[45] Date of Patent: Nov. 28, 2000

[54] SELF-ALIGNING LATCH

[75] Inventors: Thomas Joseph Kowalewski, Rochester Hills; Steven J. Sabol, Shelby Township; Gregory J. Hunter, Metamora, all of Mich.

[73] Assignee: Delphi Technologies, Inc., Troy, Mich.

[21] Appl. No.: 09/329,875

[22] Filed: Jun. 11, 1999

[51] Int. Cl.[7] ..... E05C 3/06; E05C 3/16

[52] U.S. Cl. ..... 292/216; 292/DIG. 55; 292/341.18

[58] Field of Search ..... 292/DIG. 51, DIG. 55, 292/DIG. 60, 341.18, 341.19, 213, DIG. 23, 216

[56] References Cited

U.S. PATENT DOCUMENTS

| | | | |
|---|---|---|---|
| 2,572,630 | 10/1951 | Krause | 292/216 |
| 2,658,781 | 11/1953 | Allen | 292/216 |
| 2,877,038 | 3/1959 | Kramer | 292/216 |
| 3,239,260 | 3/1966 | Beckman et al. | 292/216 |
| 5,794,992 | 8/1998 | Yoneyama | 292/216 |

*Primary Examiner*—Lynne H. Browne
*Assistant Examiner*—John B Walsh
*Attorney, Agent, or Firm*—Patrick M. Griffin

[57] ABSTRACT

A self-aligning latch for a closure panel includes a base member adapted to be attached to either one of a closure panel or vehicle structure and an attaching flange extending transversely along a side of the base member, such that the attaching flange includes an alignment slot. The self-aligning latch also includes an alignment plate pivotally mounted to the attaching flange. The self-aligning latch further includes a striker receiving member operatively mounted to the alignment plate and having a striker lead-in portion for receiving a striker attached to either one of the vehicle structure or the closure panel. The self-aligning latch includes an alignment member disposed within the alignment slot for positioning the alignment plate relative to the attaching flange to align the closure panel relative to the vehicle structure.

19 Claims, 3 Drawing Sheets

SELF-ALIGNING LATCH

TECHNICAL FIELD

The present invention relates generally to latches for vehicles and, more particularly, to a self-aligning latch for a closure panel on a vehicle.

BACKGROUND OF THE INVENTION

It is known to provide a closure panel on a vehicle such as a door, a hood, or a liftgate. The closure panel typically has a latch that operably engages a striker on the vehicle. For example, to open a door or maintain it in a closed position, the door may have a latch that operatively engages a striker mounted on a vehicle body of the vehicle. A hood may include a latch that operatively engages a striker mounted on the vehicle body, to retain the hood in a closed position relative to the vehicle body. Similarly, a liftgate may have a latch that operatively engages a striker mounted on the vehicle body, to retain the liftgate in a closed position relative to the vehicle body.

It is known that proper alignment between the latch and striker will improve the fit of the closure panel to the vehicle body. Improved fit will enhance the appearance and quietness of the vehicle. The latch and striker alignment is usually determined during vehicle assembly using a fixture.

For example, a liftgate may be divided into an upper portion and a lower portion, with each portion able to pivot between an open position and a closed position independent of the other portion. The upper portion may be made of a glass material. The liftgate includes a latch for holding the upper portion and lower portion of the liftgate closed relative to each other. A typical latch includes a first member mounted to the lower portion of the liftgate and a second member mounted to the first member. The upper portion of the liftgate includes a striker to engage the second member and is operatively positioned relative to the latch. During assembly of the vehicle, a fixture is used to adjust the second member relative to the position of the first member and the position of the striker. Further adjustment may be necessary after the latch is installed on the vehicle.

Proper alignment of the latch and striker improves the seal of the upper portion of the liftgate to the lower portion of the liftgate. Although the above latch works well, optimum alignment between the latch and striker requires the use of a separate fixture. A characteristic of this alignment method is that it is time consuming to achieve the desired accuracy. Thus, there is a need in the art to provide an improved latch for a closure panel that is self-aligning.

SUMMARY OF THE INVENTION

It is, therefore, one object of the present invention to provide a self-aligning latch for a closure panel.

It is another object of the present invention to provide a self-aligning latch that improves the alignment of a closure panel.

To achieve the foregoing objects, the present invention is a self-aligning latch for a closure panel on a vehicle. The self-aligning latch includes a base member adapted to be attached to either one of a closure panel or vehicle structure, and an attaching flange extending transversely along a side of the base member, such that the attaching flange includes an alignment slot. The self-aligning latch also includes an alignment plate pivotally mounted to the attaching flange. The self-aligning latch further includes a striker receiving member operatively mounted to the alignment plate and having a striker lead-in portion for receiving a striker attached to either one of the vehicle or the closure panel. The self-aligning latch includes an alignment member disposed within the alignment slot for positioning the alignment plate relative to the attaching flange to align the closure panel relative to the vehicle structure.

One advantage of the present invention is that an improved self-aligning latch for a closure panel is provided. Another advantage of the present invention is that the self-aligning latch eliminates the need for a separate alignment fixture. Still another advantage of the present invention is that the self-aligning latch accurately positions the striker relative to the latch for improved fit of the closure panel relative to the vehicle body, and to minimize potential noise between the latch and striker. A further advantage of the present invention is that the self-aligning latch has fewer components and cost. Still a further advantage of the present invention is that the self-aligning latch allows cross-car and fore/aft adjustment between an upper portion and a lower portion of a liftgate, to improve the alignment between the upper portion and the lower portion of the liftgate when in a closed position relative to each other.

Other objects, features and advantages of the present invention will be readily appreciated, as the same becomes better understood after reading the subsequent description taken in conjunction with the accompanying drawings.

DESCRIPTION OF THE PREFERRED EMBODIMENT

Figure 1:
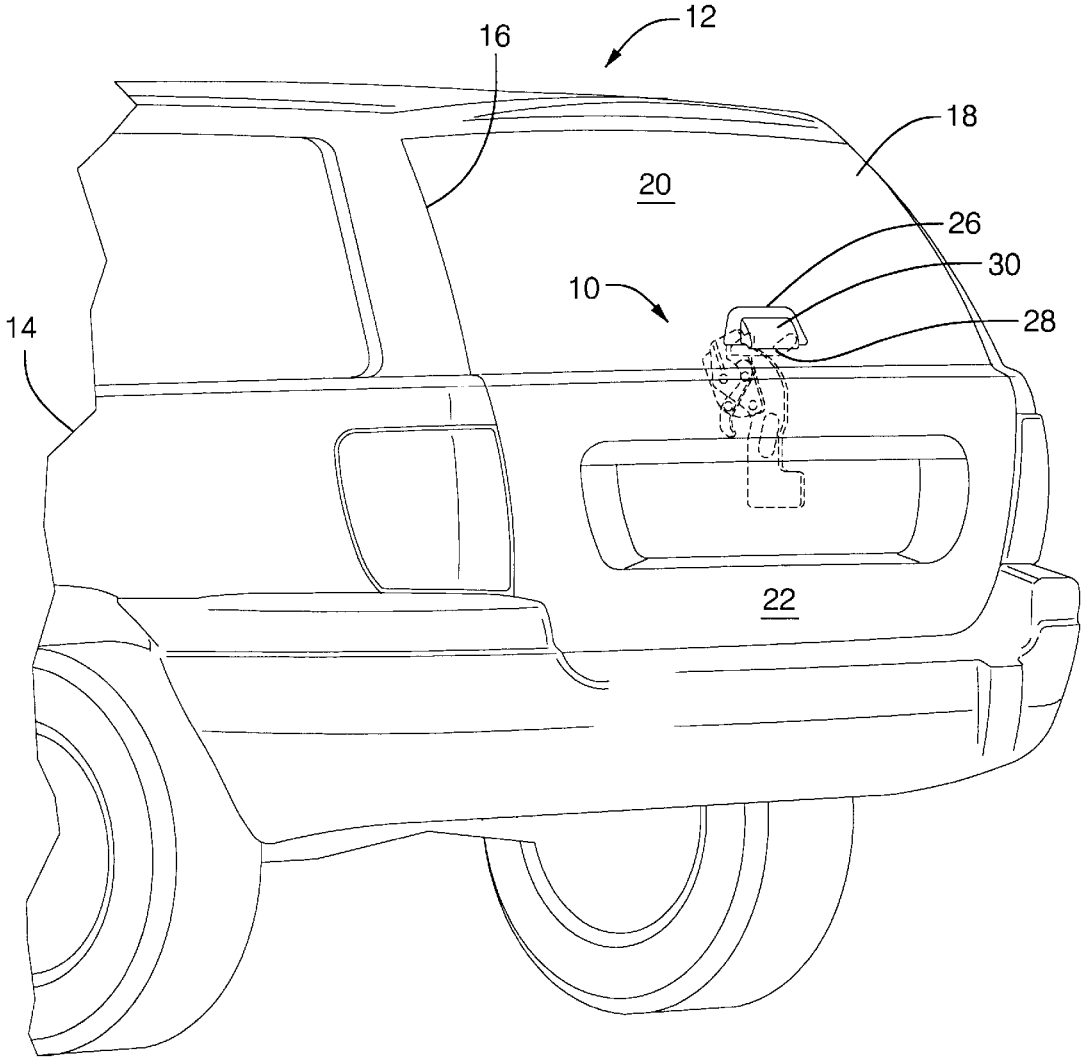
FIG. 1 is a perspective view of a self-aligning latch, according to the present invention, illustrated in operational relationship with a vehicle.

Referring to the drawings and in particular FIG. 1, one embodiment of a self-aligning latch 10, according to the present invention, is shown for a vehicle, generally indicated at 12. The vehicle 12 includes a vehicle body 14 forming an opening 16 as is known in the art.

The vehicle body 14 includes at least one closure panel such as a liftgate 18 to open and close the opening 16 in the vehicle body 14, as is well known in the art. The liftgate 18 is generally rectangular in shape, and in this embodiment, is divided into an upper liftgate portion 20 and a lower liftgate portion 22. Preferably, the upper liftgate portion 20 is made of a transparent material such as glass. The lower liftgate portion 22 is made of a metal material such as steel. It should be appreciated that the closure panel could also be a hood (not shown) or a door (not shown).

The upper and lower liftgate portions 20, 22 form a generally planar surface in a closed position relative to each other. In this embodiment, the upper liftgate portion 20 and lower liftgate portion 22 open and close independently and relative to each other. The upper liftgate portion 20 is pivotally mounted to the lower liftgate portion 22 by suitable means such as a hinge (not shown), as is known in the art. The lower liftgate portion 22 is also pivotally mounted to the vehicle body 14 by suitable means such as a hinge (not shown). The upper liftgate portion 20 and lower liftgate portion 22 may be inter-locked in a manner to be described.

The self-aligning latch 10 operatively maintains the upper and lower liftgate portions 20,22 together in a closed position relative to each other. It should be appreciated by one skilled in the art that another self-aligning latch 10 may be used to operatively maintain the liftgate 18 in a closed position relative to the vehicle body 14.

As illustrated, the self-aligning latch 10 is mounted to the lower liftgate portion 22, and operatively engages a striker 26 mounted on the upper liftgate portion 20, to maintain the upper liftgate portion 20 and lower liftgate portion 22 together in a closed position relative to each other. Preferably, the striker 26 includes a generally C-shaped member 28 that is circular in cross-sectional shape. The C-shaped member 28 is attached to a striker plate 30, and secured to the upper liftgate portion 20 by suitable means such as fasteners (not shown).

The alignment of the self-aligning latch 10 and striker 26 influence the operation of the liftgate 18. For example, a misalignment between the self-aligning latch 10 and striker 26 can result in increased closing effort or undesirable noise of the upper liftgate portion 20 or lower liftgate portion 22.

Referring to FIGS. 2 through 5, the self-aligning latch 10 includes a base member 32 that is generally planar. In this example, the base member 32 has a general "L" shape. The base member 32 includes an attaching flange 34 extending longitudinally and generally perpendicular to the base member 32. The attaching flange 34 is located transversely along a first side edge 36 of an upper end 38 of the base member 32 a sufficient amount to provide an attachment surface. The attaching flange 34 includes an alignment slot 40 for a function to be described.

The self-aligning latch 10 also includes an alignment plate 42. The alignment plate 42 is a generally planar member. The alignment plate 42 includes a channel 44 formed along an upper edge for a function to be described. The alignment plate 42 may include a stop 46 integrally formed in the alignment plate 42 and extending perpendicular to the alignment plate 42 a sufficient amount. In this embodiment, the alignment plate 42 includes two stops 46 which are an upper stop 46*a* and a lower stop 46*b*.

The alignment plate 42 is fixedly secured to the attaching flange 34 using a suitable means, such as riveting. Preferably, a rivet 48 for the alignment plate 42 is positioned near a lower end of the alignment plate 42, so as to provide a pivot point for positioning the alignment plate 42 relative to the attaching flange 34. The alignment plate 42 is adjustably secured to the attachment plate 42, using a suitable means such as a fastener or an alignment member 50, extending through the alignment slot 40 and secured with a alignment nut 52. Preferably, the position of the alignment plate 42 relative to the attaching flange 34 is determined by the placement of the alignment member 50 in the alignment slot 40.

The self-aligning latch 10 includes a detent lever 54 pivotally attached to a lower portion of the alignment plate 42 by a suitable means such as a rivet 56. The detent lever 54 includes an upper arm 54*a* and a lower arm 54*b*. Preferably, the lower arm 54*b* forms a hook shape for a function to be described.

The self-aligning latch 10 also includes a striker receiving member 58 pivotally mounted to the alignment plate 42 using a suitable means, such as a rivet (not shown) . The striker receiving member 58 is generally planar and has a rectangular shape. An upper end of the striker receiving member 58 forms a striker lead-in portion 60 having a general U-shaped opening 62 for receiving the striker 26. It should be appreciated that an upper side 64 of the striker lead-in portion 60 may ramp in an outward direction to facilitate receiving the striker 26. Preferably, the striker lead-in portion 60 is coated with a dampening material, such as plastic, to minimize rattling between the striker 26 and the striker lead-in portion 60. A lower end of the striker receiving member 58 has a notch 66, for a function to be described.

Figure 2:
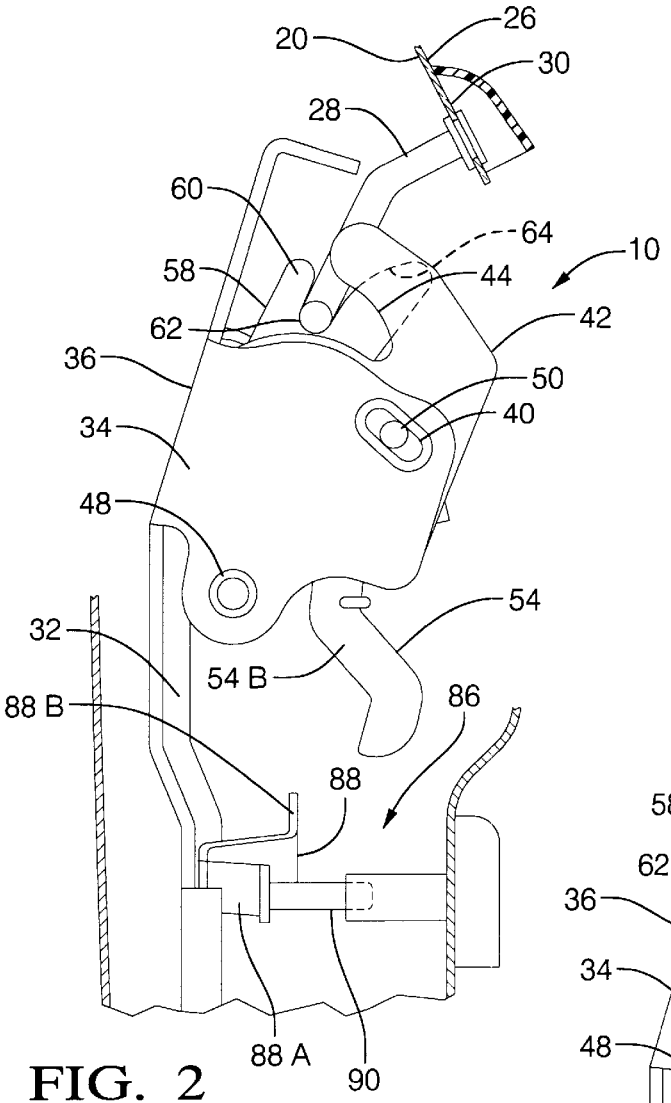
FIG. 2 is a fragmentary side view of the self-aligning latch of FIG. 1 illustrating the self-aligning latch engaged with a striker.
Figure 3:
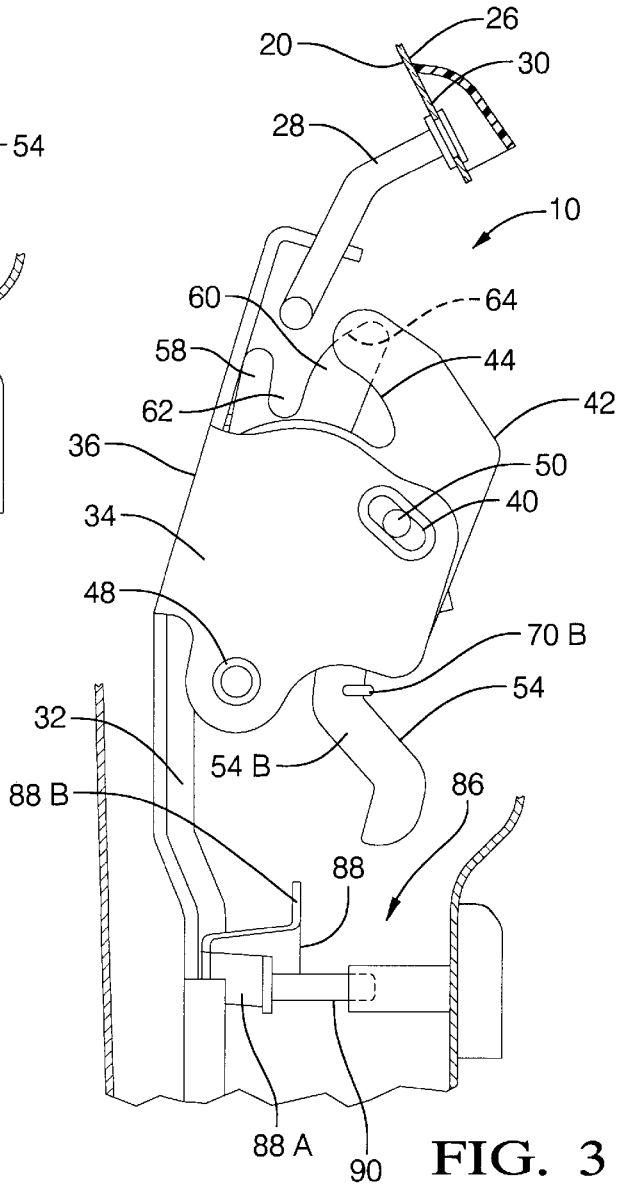
FIG. 3 is a view similar to FIG. 2 illustrating the self-aligning latch disengaged from the striker.

The self-aligning latch 10 further includes a positioning mechanism 68 for the striker receiving member 58. The positioning mechanism 68 operatively moves the striker receiving member 58 between a striker engaged position as shown in FIG. 2 and a striker released position as shown in FIG. 3. In this embodiment, the positioning mechanism 68 includes a torsion spring 70 as is known in the art. The positioning mechanism 68 also includes a post 72 for supporting the torsion spring 70. The post 72 is attached to the striker receiving member 58 by a suitable means, such as riveting. The post 72 extends generally perpendicular to the striker receiving member 58 a sufficient distance to provide a support for the torsion spring 70. Preferably, an end of the post 72 forms a cap 74 for retaining a coiled portion of the torsion spring 70 on the post 72.

The positioning mechanism 68 also includes a positioning mechanism support 76 attached to the striker receiving member 58 by a suitable means, such as riveting. The positioning mechanism support 76 is a post extending perpendicular to the striker receiving member 58 a suitable length to support a first end 70*a* of the torsion spring 70. The positioning mechanism support 76 forms a cap 78 at an outer end, and has a circumferentially extending groove 80 adjacent the cap 78. The first end 70*a* of the torsion spring 70 is positively retained within the groove 80. A second end 70*b* of the torsion spring 70 is hooked around the lower arm 54*b* of the detent lever 54, to maintain the torsion spring 70 in an initial position.

To install the self-aligning latch 10 on the vehicle 12, the latch 10 is secured using a suitable means such as fasteners (not shown) . In this embodiment, the self-aligning latch 10 is installed on an upper end of the lower liftgate portion 22, relative to the striker 26 positioned on a lower end of the upper liftgate portion 20.

Figure 4:
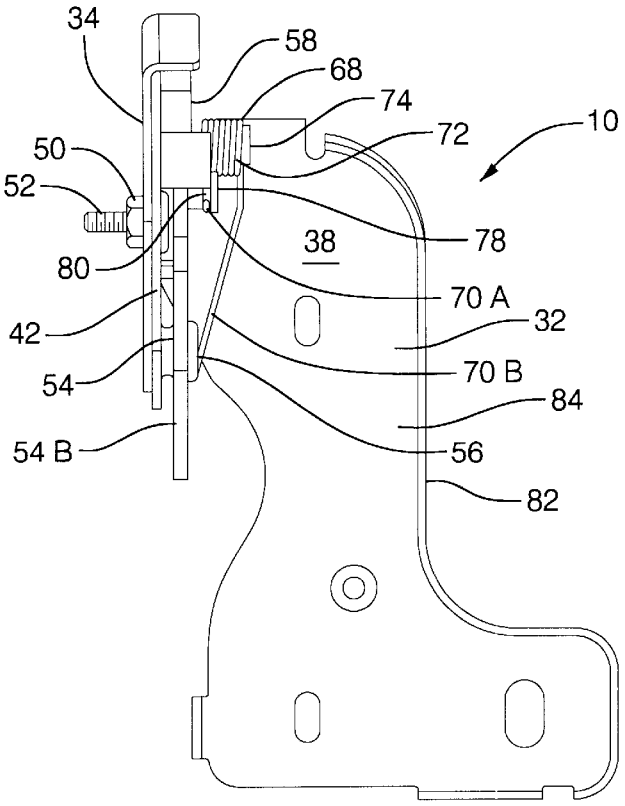
FIG. 4 is a front view of the self-aligning latch of FIG. 1.
Figure 5:
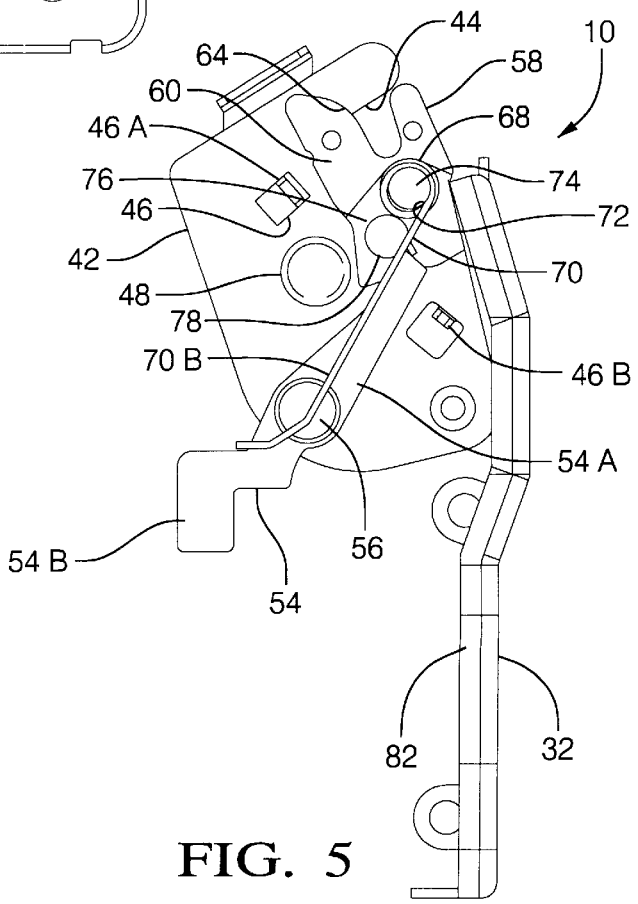
FIG. 5 is a side view of the self-aligning latch of FIG. 1.

It should be appreciated that the position of the alignment plate 42 relative to the base member 32 may be preset, by fixedly positioning the alignment member 50 within the alignment slot 40. Preferably, the position of the alignment plate 42 is preset prior to vehicle assembly. Advantageously, the position and shape of the alignment slot 40 influences the amount of travel available to the alignment plate 42. In this embodiment, the oval shape of the alignment slot 40, illustrated in FIG. 4, provides ten (10°) degrees of travel.

Advantageously, the fore-aft and cross-car alignment of the upper liftgate portion 20 to the lower liftgate portion 22 can be readjusted after the self-aligning latch 10 is installed by repositioning the alignment plate 42 relative to the base member 32. This is accomplished by loosening the alignment nut 52, pivoting the alignment plate 42 to the desired position, and then tightening the alignment nut 52. As is known in the art, the length of the vehicle 12 is referred to as the fore/aft position and the width of the vehicle 12 is the cross-car position, while the height is the up-down position.

The striker receiving member 58 is initially in a rearward position prior to closing the upper liftgate portion 20 relative to the lower liftgate portion 22. As the upper liftgate portion 20 is directed in a closing direction relative to the lower liftgate portion 22, the striker 26 is received by the striker lead-in portion 60 of the striker receiving member 58. The force from the movement of the striker 26 in the closing direction causes the striker receiving member 58 to pivot forward until the upper arm 54*a* of the detent lever 54 is engaged within the notch 66 in the lower end of the striker receiving member 58. The channel 44 in the alignment plate 42 assists in retaining the striker 26 within the striker lead-in portion 60 of the striker receiving member 58.

To open the upper liftgate portion 20, a handle (not shown) positioned on the outside of the lower liftgate portion 22 is operably connected to the self-aligning latch 10. For example, a push button (not shown) extends between the outside of the vehicle 12 and the lower arm 54*b* of the detent lever 54. In actuating the self-aligning latch 10, the push button pushes on the detent lever 54, causing the detent lever 54 to pivot forward until it is stopped by the lower stop 46*b*. The striker receiving member 58 is released from the notch 66 in the striker receiving member 58. The striker receiving member 58 pivots backward until a lower end of the striker receiving member 58 is stopped by the upper stop 46*a*. Advantageously, the force of the returning striker receiving member 58 as a result of the torsion spring causes the striker 26 and upper liftgate portion 20 to move away from the lower liftgate portion 22.

The base member 32 includes a strengthening flange 82 extending transversely along a second side edge 84 for providing additional strength to the base member 32. Advantageously, the base member 32 may provide a mounting surface for another component, such as a sensor (not shown). An example of a sensor is a position sensor that detects conditions such as whether the upper liftgate portion 20 is engaged by the self-aligning latch 10 on the lower liftgate portion 22.

The self-aligning latch 10 may also provide support for a locking mechanism 86 that simultaneously locks or unlocks an upper liftgate portion lock (not shown) or lower liftgate portion lock (not shown). For example, the locking mechanism 86 may include a bell crank 88 pivotally mounted to a lower end of the base member 32 by a suitable means, such as riveting. The bell crank 88 includes a first arm 88*a* and a second arm 88*b*. The first arm 88*a* of the bell crank 88 includes a post 90 extending generally perpendicular to the first arm 88*a* of the bell crank 88 a sufficient length. The post 90 is operatively connected to the upper liftgate portion lock, as is known in the art. The second arm 88*b* of the bell crank 88 is operatively connected to the lower liftgate portion lock as is known in the art. Advantageously, the insertion of a key in either one of the upper or lower liftgate portion locks operatively actuates the bell crank 88, to simultaneously lock or unlock the upper liftgate portion lock or lower liftgate portion lock.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A self-aligning latch for a closure panel on a vehicle comprising:

a base member adapted to be attached to either one of a closure panel and vehicle structure;

an attaching flange extending transversely along and generally perpendicular to said base member, wherein said attaching flange includes an alignment slot and said attaching flange and said base member are integral and formed as one-piece;

an alignment plate pivotally mounted to said attaching flange;

a striker receiving member pivotally mounted to said alignment plate, wherein said striker receiving member includes a striker lead-in portion for receiving a striker attached to either one of the vehicle structure and the closure panel; and an alignment member attached to said alignment plate and disposed within said alignment slot for positioning said alignment plate relative to said attaching flange to align the closure panel relative to the vehicle structure.

2. A self-aligning latch as set forth in claim 1 wherein said base member includes a strengthening flange extending transversely along said base member.

3. A self-aligning latch as set forth in claim 1 including a positioning mechanism for operatively moving said striker receiving member between a striker engaged position and a striker released position.

4. A self-aligning latch as set forth in claim 3 wherein said positioning mechanism comprises a spring.

5. A self-aligning latch as set forth in claim 1 wherein said striker lead-in portion has a U-shape.

6. A self-aligning latch for a closure panel on a vehicle comprising:

a base member adapted to be attached to either one of a closure panel and vehicle structure;

an attaching flange extending transversely along said base member, wherein said attaching flange includes an alignment slot;

an alignment plate pivotally mounted to said attaching flange;

a striker receiving member operatively mounted to said alignment plate wherein said striker receiving member includes a striker lead-in portion for receiving a striker attached to either one of the vehicle structure and the closure panel;

an alignment member disposed within said alignment slot for positioning said alignment plate relative to said attaching flange to align the closure panel relative to the vehicle structure; and wherein said alignment plate includes a channel for receiving the striker.

7. A self-aligning latch for a closure panel on a vehicle comprising:

a base member adapted to be attached to either one of a closure panel and vehicle structure;

an attaching flange integral and formed as one-piece with said base member and extending transversely along said base member, wherein said attaching flange includes an alignment slot;

an alignment plate pivotally mounted to said attaching flange, wherein said alignment plate includes a channel for receiving the striker;

a striker receiving member operatively mounted to said alignment plate, wherein said striker receiving member includes a striker lead-in portion having a U-shape for receiving a striker attached to either one of the vehicle structure and the closure panel;

a positioning mechanism mounted to said striker receiving member for operatively moving said striker receiving member between a striker engaged position and a striker released position;

a detent lever having an upper arm and a lower arm and said detent lever being pivotally attached to said alignment plate, wherein said upper arm of said detent lever is engaged by said striker receiving member to hold said striker receiving member in said striker engaged position, and said lower arm of said detent lever is actuated to disengage said striker receiving member from said detent lever and return said striker receiving member to said striker released position; and an alignment member disposed within said alignment slot for positioning said alignment plate relative to said attaching flange to align the closure panel relative to the vehicle structure.

8. A self-aligning latch for a closure panel on a vehicle comprising:

a base member adapted to be attached to either one of a closure panel and vehicle structure;

an attaching flange extending transversely along said base member, wherein said attaching flange includes an alignment slot;

an alignment plate pivotally mounted to said attaching flange;

a striker receiving member operatively mounted to said aliment plate, wherein said striker receiving member includes a striker lead-in portion for receiving a striker attached to either one of the vehicle structure and the closure panel;

an alignment member disposed within said alignment slot for positioning said alignment plate relative to said attaching flange to align the closure panel relative to the vehicle structure;

a positioning mechanism for operatively moving said striker receiving member between a striker engaged position and a striker released position, wherein said positioning mechanism comprises a spring; and wherein said positioning mechanism includes a detent lever pivotally attached to said alignment plate that holds said striker receiving member in said striker engaged position.

9. A self-aligning latch as set forth in claim 8 wherein said detent lever includes a lower arm to disengage said striker receiving member from said detent lever and return said striker receiving member to said striker released position.

10. A self-aligning latch as set forth in claim 9 wherein said alignment plate includes a lower stop extending generally perpendicular thereto, for limiting travel of said detent lever in actuating said detent lever to release the striker.

11. A self-aligning latch as set forth in claim 10 wherein said alignment plate includes an upper stop extending generally perpendicular thereto, for limiting travel of said striker receiving member when said detent lever is actuated to release the striker.

12. A self-aligning latch for a closure panel on a vehicle comprising:

a base member adapted to be attached to either one of a closure panel and vehicle structure;

an attaching flange extending transversely along said base member, wherein said attaching flange includes an alignment slot;

an alignment plate pivotally mounted to said attaching flange;

a striker receiving member operatively mounted to said alignment plate, wherein said striker receiving member includes a striker lead-in portion for receiving a striker attached to either one of the vehicle structure and the closure panel;

a positioning mechanism mounted to said striker receiving member for operatively moving said striker receiving member between a striker engaged position and a striker released position;

a detent lever pivotally attached to said alignment plate that holds said striker receiving member in said striker engaged position; and an alignment member disposed within said alignment slot for positioning said alignment plate relative to said attaching flange to align the closure panel relative to the vehicle structure.

13. A self-aligning latch as set forth in claim 12 wherein said attaching flange and said base member are integral and formed as one-piece.

14. A self-aligning latch as set forth in claim 12 wherein said base member includes a strengthening flange extending transversely along said base member.

15. A self-aligning latch as set forth in claim 12 wherein said alignment plate includes a channel for receiving the striker.

16. A self-aligning latch as set forth in claim 12 wherein said striker lead-in portion has a U-shape.

17. A self-aligning latch as set forth in claim 12 wherein said positioning mechanism comprises a spring.

18. A self-aligning latch as set forth in claim 12 wherein said alignment plate includes a lower stop extending generally perpendicular thereto, for limiting travel of said detent lever in actuating said detent lever to release the striker.

19. A self-aligning latch as set forth in claim 18 wherein said alignment plate includes an upper stop extending generally perpendicular thereto, for limiting travel of said striker receiving member when said detent lever is actuated to release the striker.

* * * * *